US005156583A

United States Patent [19]

Baas

[11] Patent Number: 5,156,583

[45] Date of Patent: Oct. 20, 1992

[54] APPARATUS FOR MAKING A FOLDABLE ONE-PIECE DOUBLE-LAMINATED SIDEWALL BOX

[75] Inventor: Richard Baas, Langley, British Columbia, Canada

[73] Assignee: DLS Box Machines Ltd., Langley, British Columbia, Canada

[21] Appl. No.: 695,403

[22] Filed: May 3, 1991

[51] Int. Cl.[5] ..... B31B 3/46; B31B 3/48

[52] U.S. Cl. ..... 493/140; 493/174

[58] Field of Search ..... 443/127, 140, 167, 174, 443/175, 183

[56] References Cited

U.S. PATENT DOCUMENTS

| | | | |
|---|---|---|---|
| 2,846,929 | 8/1958 | Hickin . | |
| 2,846,930 | 8/1958 | Gross . | |
| 2,929,302 | 3/1960 | Brown | 493/174 |
| 2,993,419 | 7/1961 | Currie . | |
| 3,078,769 | 2/1963 | Flynn et al. . | |
| 3,125,007 | 3/1964 | Jaroff et al. | 493/174 |
| 3,541,930 | 11/1970 | Goodrich . | |
| 3,648,573 | 3/1972 | Le Febvre et al. . | |
| 3,973,475 | 8/1976 | Nigrosh . | |
| 4,003,299 | 1/1977 | Sternheimer . | |
| 4,240,337 | 12/1980 | Casutt | 493/167 |
| 4,578,054 | 3/1986 | Herrin . | |
| 4,661,091 | 4/1987 | Moen . | |

*Primary Examiner*—William E. Terrell
*Attorney, Agent, or Firm*—Barrigar & Oyen

[57] ABSTRACT

Box forming apparatus for forming a box from a box blank. The blank has a base with first, second, third and fourth side members extending along respective sides of the base. One of the opposed pairs of side members has parallel inner and outer portions. The other pair has flaps extending from each opposed end. In the apparatus, a pair of spaced, parallel frame members are slidably mounted on a fixed framework. A box forming plate moves vertically between the frame members. A rectangular box forming piston moves vertically between the frame members in alignment with and against the box forming plate. The forming plate and piston have the same size and shape as the box blank's base. A movable frame is provided for vertical displacement beneath the frame members. A flap tuck mechanism on the first frame members folds the flaps perpendicular to the other side members. The flap tuck mechanism is actuated by vertical displacement of the movable frame toward the frame members. A flap raising mechanism on the movable frame moves the inner and outer portion-bearing side members upwardly relative to the box blank's base. A controllably actuable flap folding mechanism on the movable frame inclines the outer portions of the side members at an angle relative to their inner portions.

24 Claims, 11 Drawing Sheets

APPARATUS FOR MAKING A FOLDABLE ONE-PIECE DOUBLE-LAMINATED SIDEWALL BOX

FIELD OF THE INVENTION

This application pertains to a box having noninterlocking, double-laminated sidewalls, which may be formed by high speed folding and gluing of a single box blank. The application also pertains to apparatus for repetitive high speed formation of such boxes.

BACKGROUND OF THE INVENTION

The prior art has evolved a variety of box structures, including wrapped boxes, simplex boxes, and foldable one-piece double-laminated sidewall boxes. "Wrapped" boxes are constructed by taping discrete segments of cardboard or stiff paper together at their corners to form a box, and then dressing the box by wrapping a relatively thin sheet of material around the box and gluing it in position. A "simplex" box is constructed by punching a box blank out of a sheet of stock and then folding the blank to form a box. The simplex box is held together by flaps which are tucked into and lockably engage mating slots provided in the box blank. "Double-laminated sidewall" boxes are also constructed by punching a box blank out of a sheet of stock and then folding the blank to form a box. The double-laminated sidewall box is glued together.

Double-laminated sidewall boxes are preferable to wrapped or simplex boxes because they are stronger and lend themselves to inexpensive, high-speed fabrication. Some problems have however been encountered in high speed fabrication of double-laminated sidewall boxes. For example, when the box side flaps are raised into position, they sometimes catch the adjacent box sidewall members, disrupting the high-speed box fabrication process. The mandrel against which the sidewalls are folded to form the box can also become stuck to the pre-glued box surfaces, which also disrupts the high-speed box fabrication process. The present invention overcomes these disadvantages, while providing a stronger box structure.

SUMMARY OF THE INVENTION

In accordance with the preferred embodiment, the invention provides a foldable box comprising a base member having first, second, third and fourth sides; a first side member comprising a first inner portion extending along the first side and a first outer portion extending along the first inner portion, parallel to the first side; a second side member comprising a second inner portion extending along the second side and a second outer portion extending along the second inner portion, parallel to the second side; a third side member comprising a third inner portion extending along the third side and a third outer portion extending along the third inner portion, parallel to the third side; and, a fourth side member comprising a fourth inner portion extending along the fourth side and a fourth outer portion extending along the fourth inner portion, parallel to the fourth side. A first side flap is affixed to a first end of the first inner portion and extends beyond the juncture of the second inner and outer portions when the box is in its laid-flat configuration. Similarly, a second side flap is affixed to a second end of the first inner portion and extends beyond the juncture of the fourth inner and outer portions; a third side flap is affixed to a first end of the third inner portion and extends beyond the juncture of the second inner and outer portions; and, a fourth side flap is affixed to a second end of the third inner portion and extends beyond the juncture of the fourth inner and outer portions. The side flaps are preferably tapered and provided with rounded corners.

The box has an assembled configuration in which the first outer portion is folded over the first inner portion and the folded first portions are further folded perpendicular to the base member along the juncture of the first inner portion with the first side The third outer portion is folded over the third inner portion and the folded third portions are further folded perpendicular to the base member along the juncture of the third inner portion with the third side The first, second, third and fourth side flaps are folded toward the base member, perpendicular to the folded first and third portions respectively. The second inner portion is folded perpendicular to the base member along the juncture of the second inner portion with the second side, against the folded first and third side flaps; and, the second outer portion is folded over the second inner portion and over first and third side flaps. The fourth inner portion is folded perpendicular to the base member along the juncture of the fourth inner portion with the fourth side, against the folded second and fourth side flaps; and, the fourth outer portion is folded over the fourth inner portion and over second and fourth side flaps.

The invention also provides a box forming apparatus, having a first pair of parallel frame members mounted on a fixed framework; a box forming plate vertically displaceable between the first frame members; a rectangular box forming piston vertically aligned with the box forming plate and displaceable between the first frame members, against the box forming plate; a movable frame vertically displaceable beneath the first frame members; a flap tuck means on the first frame members, actuable by vertical displacement of the movable frame toward the first frame members; a flap raising means on the movable frame; and, a controllably actuable flap folding means on the movable frame.

First and second side rams are mounted on the framework for slidable displacement toward one another, against opposed sides of the box forming piston.

Advantageously, frame moving means are provided for vertically displacing the movable frame. The frame moving means may incorporate a cable coupled between the movable frame and a pulley; and, a controllable drive means for controllably rotating the pulley. The controllable drive means includes a gear fixed to the pulley; a slidably displaceable, geared rack drivingly coupled to the gear; and, means for controllably slidably displacing the rack, which may be a cylinder having a slidably displaceable pin mounted for engagement with the rack Adjusting means are advantageously provided for adjusting the displacement between the first pair of parallel frame members. The adjusting means may comprise first and second screw feed means threadably coupled between opposed ends of the first pair of parallel frame members. A drive means preferably interconnects the first and second screw feed means. The drive means may comprise first and second gears respectively fixed at opposed ends of the first and second screw feed means; and, a chain drivingly coupled between the first and second gears. Similar means may be provided for adjusting the displacement between the second pair of parallel frame members A second pair of parallel frame members are preferably mounted on the movable frame; and, a third pair of parallel frame members are mounted on each of the second pair of parallel frame members, to extend towards the first frame members. The flap raising and flap folding means are mounted on the third frame members.

The flap tuck means may comprise a slidably displaceable pin mounted on one of the first frame members; and, a cam on one of the third frame members, the cam being aligned to displace the pin as the movable frame is vertically displaced toward the first frame members. Similar pin/cam arrangements are provided for tucking each of the four side flaps of the box.

The flap raising means may comprise a vertically projecting segment on one of the third frame members, the end of the segment terminating beneath the cam. Similar projecting segments are provided for raising each of the second and fourth side members of the box.

The flap folding means may comprise a controllably actuable piston mounted beneath the end of the segment. Similar pistons are provided for folding the outer surfaces of each of the second and fourth outer portions of the box.

DETAILED DESCRIPTION OF THE PREFERRED EMBODIMENT

Figure 1:
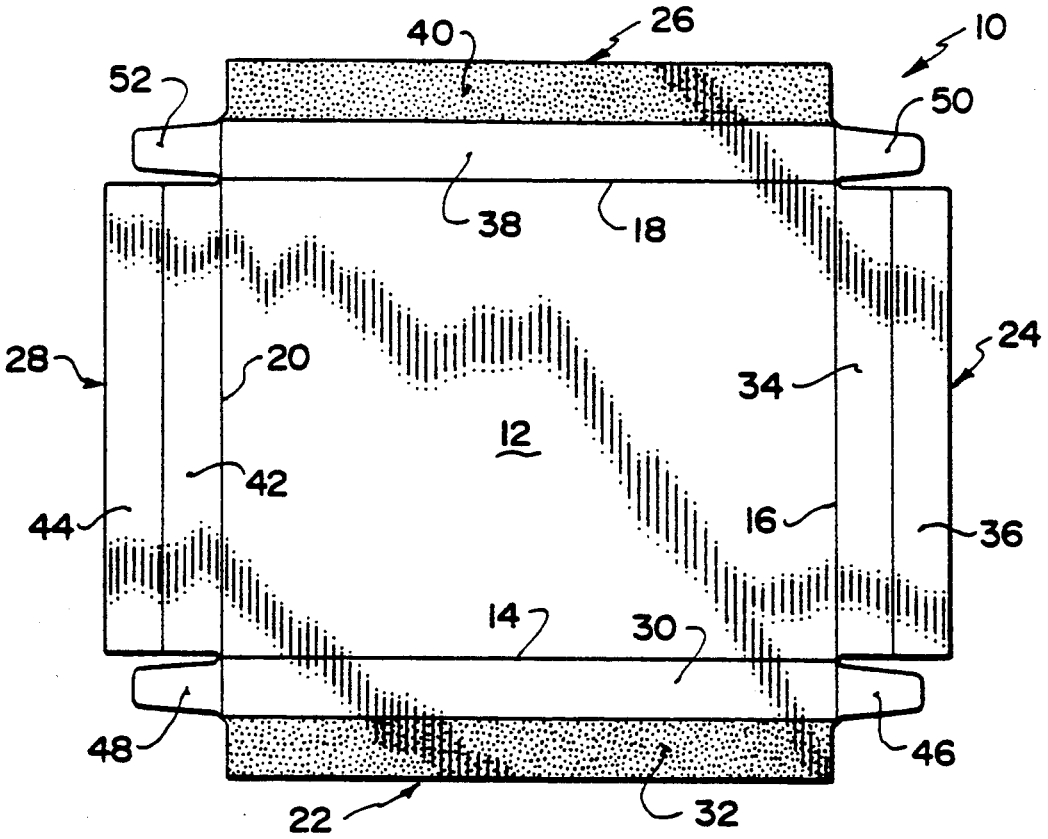
FIG. 1 is a top plan view of a foldable box blank according to the preferred embodiment of the invention.

FIG. 1 depicts foldable box blank 10 in its initial, laid-flat configuration. Box blank 10 consists of rectangular base member 12 having first, second, third and fourth sides 14, 16, 18 and 20 to which first, second, third and fourth side members 22, 24, 26 and 28 are respectively affixed.

First side member 22 is made up of a first inner portion 30 extending along first side 14 and a first outer portion 32 extending along first inner portion 30, parallel to first side 14. Second side member 24 similarly comprises a second inner portion 34 extending along second side 16 and a second outer portion 36 extending along second inner portion 34, parallel to second side 16. Third side member 26 comprises a third inner portion 38 extending along third side 18 and a third outer portion 40 extending along third inner portion 38, parallel to third side 18. Fourth side member 28 comprises a fourth inner portion 42 extending along fourth side 20 and a fourth outer portion 44 extending along fourth inner portion 42, parallel to fourth side 20.

Figure 6:
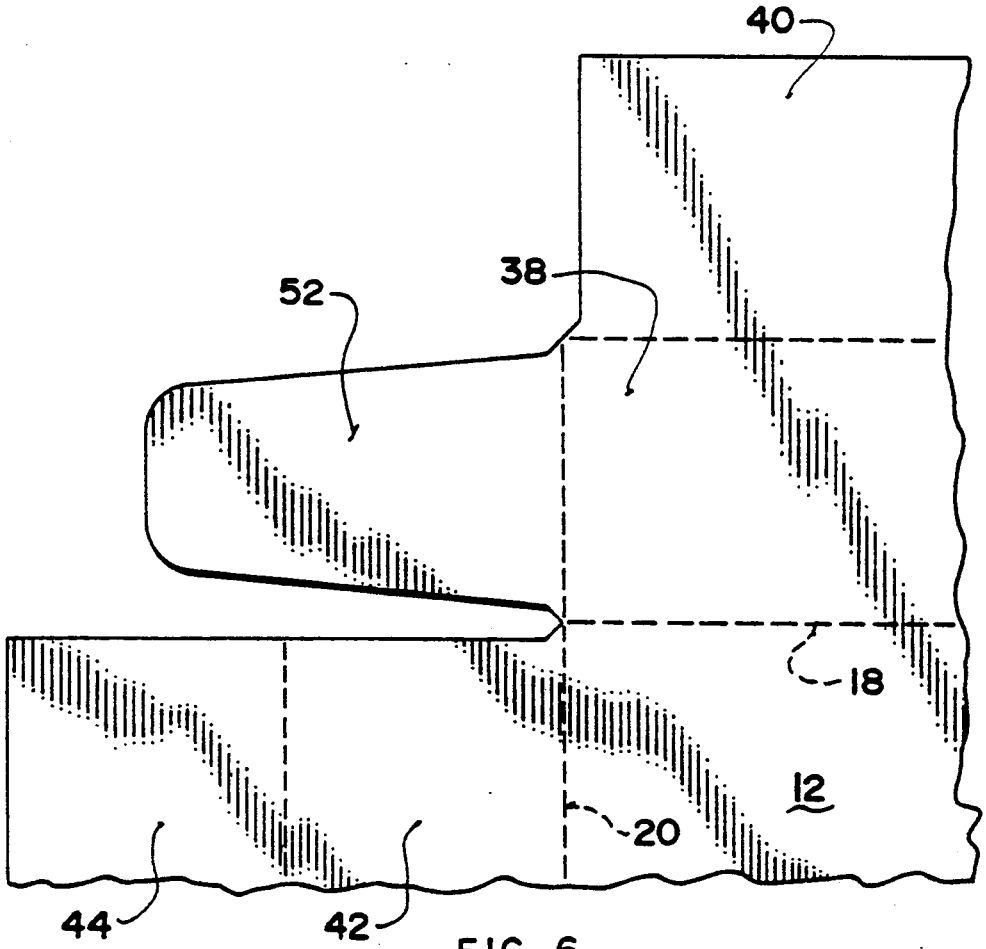
FIG. 6 is an enlarged plan view of one of the corners of the box blank of FIG. 1.

A first side flap 46 is affixed to a first end of first inner portion 30 and extends beyond the juncture of second inner and outer portions 34, 36 when blank 10 is in its laid-flat configuration depicted in FIG. 1. A second side flap 48 is affixed to the opposed end of first inner portion 30 and extends beyond the juncture of fourth inner and outer portions 42, 44. A third side flap 50 is affixed to a first end of third inner portion 38 and extends beyond the juncture of second inner and outer portions 34, 36. A fourth side flap 52 is affixed to the opposed end of third inner portion 38 and extends beyond the juncture of fourth inner and outer portions 42, 44. First, second, third and fourth side flaps 46, 48, 50, 52 are tapered and provided with rounded corners (as illustrated best in the enlarged view of fourth side flap 52 provided in FIG. 6).

Figure 2:
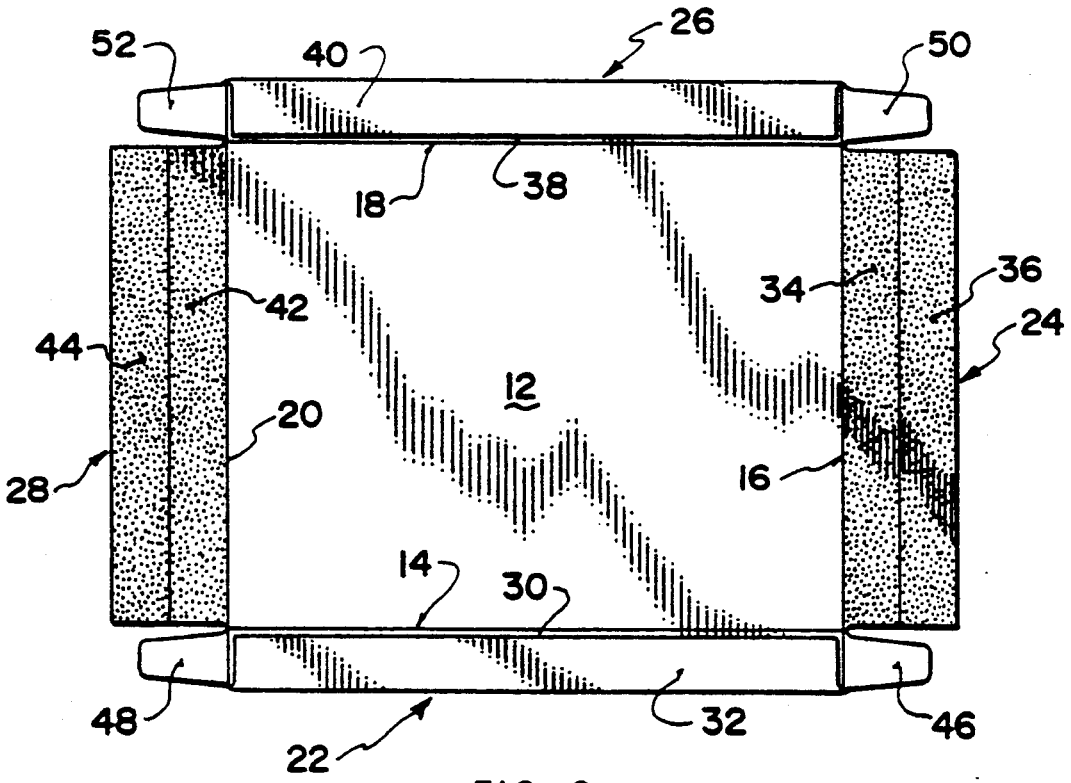
FIG. 2 shows the box blank of FIG. 1 after a first pair of sidewalls have been folded.

The manner in which box blank 10 is assembled to form box 100 depicted in FIG. 5 will now be described. First, glue is applied to first and third outer portions 32, 40 as indicated by the dotted regions in FIG. 1. First outer portion 32 is then folded over first inner portion 30, as shown in FIG. 2. Simultaneously, third outer portion 40 is folded over third inner portion 38. Glue is then applied to second and fourth inner and outer portions 34, 36, 42, 44 as indicated by the dotted regions in FIG. 2.

Folded first side member 22 is then further folded perpendicular to base member 12 along first side 14. Simultaneously, folded third side member 26 is further folded perpendicular to base member 12 along third side 18. First, second, third and fourth side flaps 46, 48, 50, 52 are then folded in toward base member 12, perpendicular to folded first and third members 22, 26 respectively, to yield the structure depicted in FIG. 3, except that second and fourth side members 24, 28 remain flat as indicated by dashed lines in FIG. 3. The tapered, roundcornered side flaps easily clear the adjacent portions of second and fourth outer portions 36, 44, facilitating high speed box formation. Prior art non-tapered, sharp-cornered side flaps tend to catch against the adjacent outer portions as the flaps are folded, disrupting high speed box forming operations.

Figure 3:
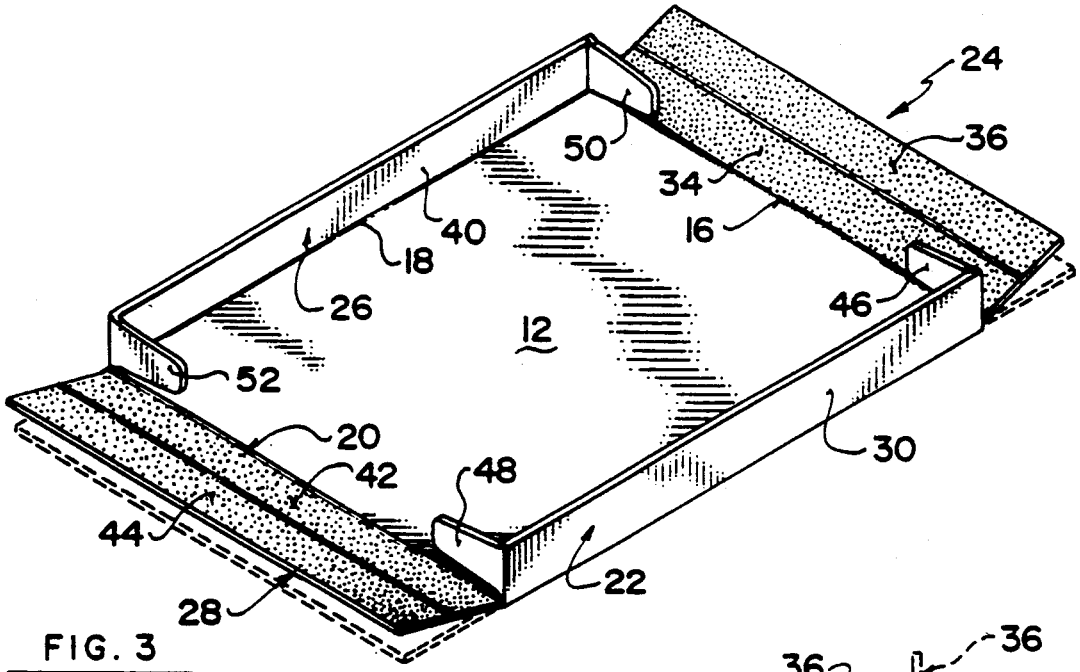
FIG. 3 is a pictorial illustration of the box blank of FIG. 2 after the sidewall end flaps have been folded, and after the second pair of sidewalls have been folded slightly upwardly.
Figure 4A:
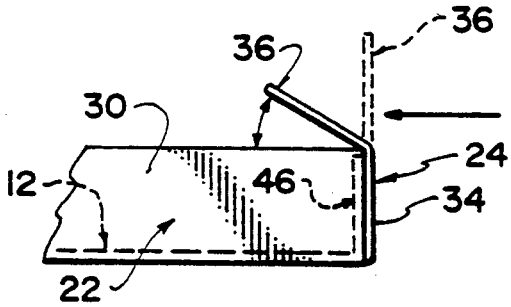
FIG. 4A is an end view of one of the corners of the box blank of FIG. 4, after the second pair of sidewalls have been folded partially inwardly.
Figure 4:
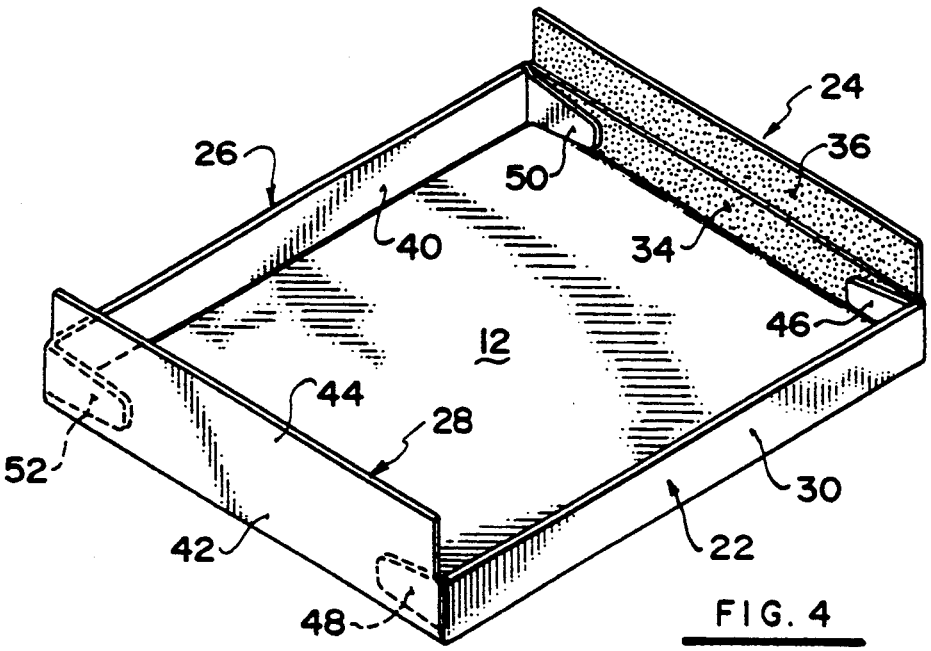
FIG. 4 shows the box blank of FIG. 3 after the second pair of sidewalls have been folded to the full upright position.

Second and fourth side members 24, 28 are then raised, as indicated by the solid outlines of those portions in FIG. 3, until they reach the full upright positions shown in FIG. 4. This places second inner portion 34 perpendicular to base member 12 and against folded first and third side flaps 46, 50, and places fourth side member 28 perpendicular to base member 12 and against folded second and fourth side flaps 48, 52. The extended length of side flaps 46, 48, 50, 52 serves to hold a forming mandrel inserted within the box cavity away from the glued surfaces of second and fourth side members 24, 28. Prior art double-laminated sidewall boxes have relatively short side flaps, which are insufficient to prevent the mandrel from contacting the glued surfaces, which disrupts the box forming operation. Second outer portion 36 is then folded over second inner portion 34 and over first and third side flaps 46, 50. Fourth outer portion 44 is folded over fourth inner portion 42 and over second and fourth side flaps 48, 52 to form box 100.

Figure 5:
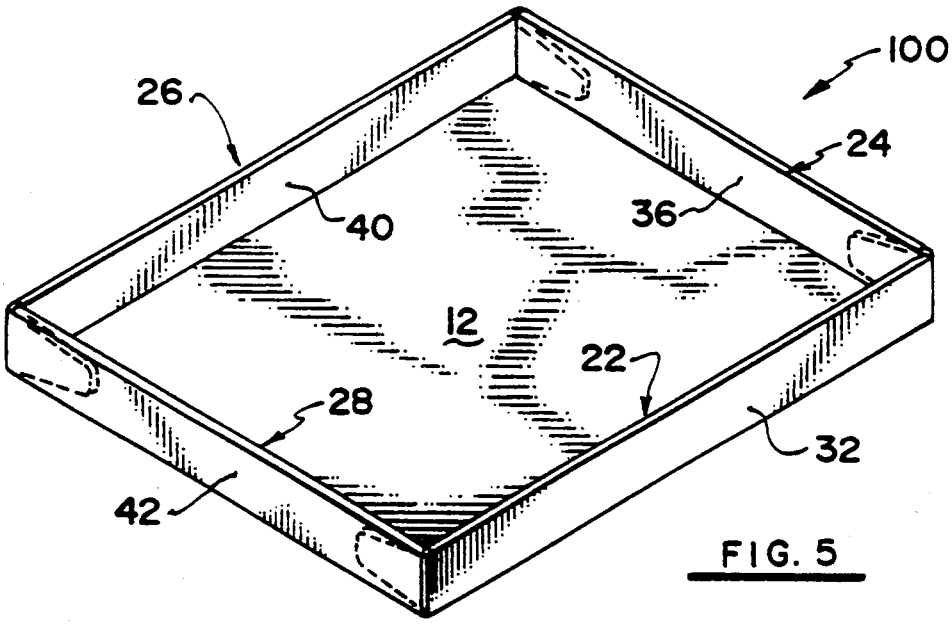
FIG. 5 is an isometric view of the fully assembled box.

FIGS. 7 through 16 illustrate an apparatus 200 which is adapted to receive the glued, partially folded box blank depicted in FIG. 2, and further fold it to form box 100 depicted in FIG. 5. Before box blank 10 is presented to apparatus 200, blank 10 is first processed through a conventional edge gluing apparatus (not shown) which applies glue to first and third outer portions 32, 40; folds those portions over first and third inner portions 30, 38 respectively; and compresses the folded portions, allowing the glue to seal the folded portions firmly together. The gluing apparatus then pushes first, second, third and fourth side flaps 46, 48, 50 and 52 downwardly (as viewed in FIG. 1) to remove them from the plane of the laid-flat box blank 10 and then applies glue to second and fourth inner and outer portions 34, 36, 42 and 44 to yield the partially folded, glued box blank depicted in FIG. 2. It is this partially folded, glued box blank which is presented to apparatus 200 for formation of box 100, as will now be described.

The partially folded, glued box blank depicted in FIG. 2 is inserted, glued side up, into apparatus 200 by conveyor 202 (FIG. 9) through the front side 204 of apparatus 200. The outer edges of second and fourth side members 24, 28 slide along the opposed, grooved portions of "L" shaped guide rails 205*a*, 205*b* until the blank encounters a pair of adjustable guide rail stops 207*a*, 207*b* (best seen in FIG. 10) which stop the blank's forward motion, causing the blank to come to rest atop rectangular box forming vacuum plate 206 with first and third side members 22, 26 extending perpendicular to guide rails 205*a*, 205*b*.

Guide rails 205*a*, 205*b* are slidably mounted on front frame member 209 and on a corresponding frame member (not visible in the drawings) located on the rear side of apparatus 200. By slidably adjusting the displacement between guide rails 205*a*, 205*b* prior to insertion of a box blank, one may quickly adapt apparatus 200 to form boxes of different sizes. Similar rapid adjustment of apparatus 200 is facilitated at other points, as will be hereinafter explained.

Figure 15:
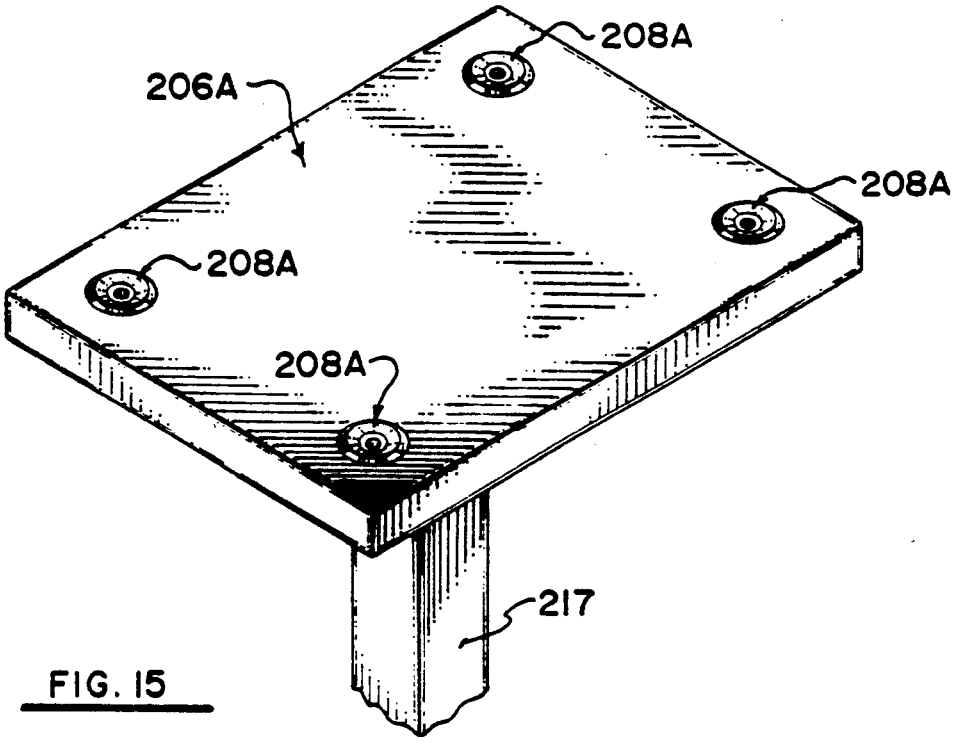
FIG. 15 is an oblique, pictorial illustration of an alternative vacuum plate for the apparatus of FIG. 7; and, FIG. 16 an oblique, pictorial illustration of the mechanism which raises and lowers the movable frame of the apparatus of FIG. 7.

A suitable sensor such as a microswitch, photoelectric cell, or other detector (not shown) senses the correct positioning of a box blank atop vacuum plate 206 as aforesaid. Vacuum is then applied to vacuum plate 206, causing air to be sucked through dual vacuum plate apertures 208, thereby drawing the box blank downwardly against the top surface of vacuum plate 206 to hold the box blank firmly in place. FIG. 15 illustrates an alternative vacuum plate 206*a* having a different arrangement of four corner-positioned vacuum plate apertures 208*a* which may be used instead of vacuum plate 206.

Figure 8:
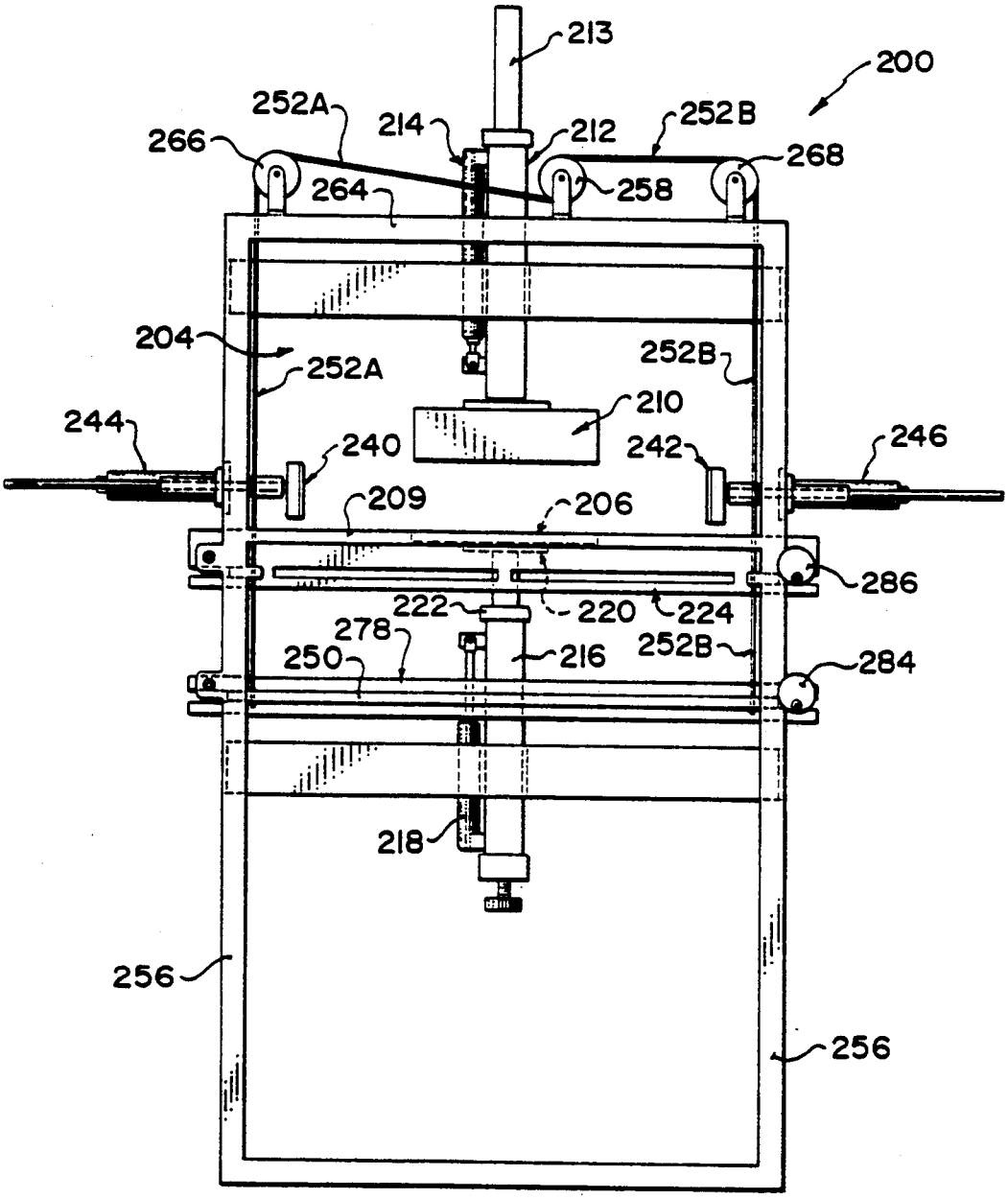
FIG. 8 is a front elevation view of the apparatus of FIG. 7, various portions of the apparatus having been omitted from FIG. 8 to avoid obscuring details of the portions shown.
Figure 14:
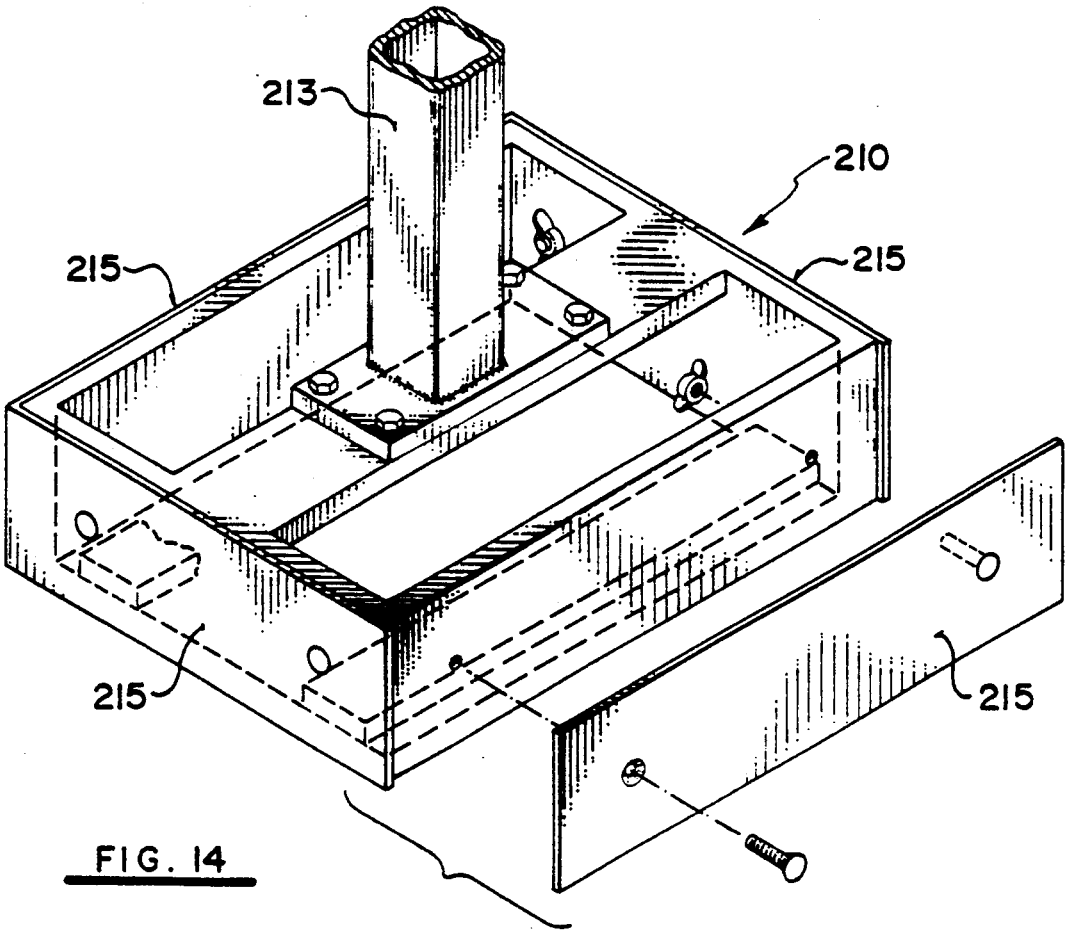
FIG. 14 is an oblique, pictorial, partially fragmented, partially exploded illustration of the box forming piston of the apparatus of FIG. 7.

While vacuum is applied as aforesaid to hold the box blank firmly in place atop vacuum plate 206, rectangular-sided box forming piston 210 is forced downwardly to compress the box blank between the bottom face of piston 210 and the upper face of vacuum plate 206. This is accomplished by actuating pneumatic ram 212 via pneumatic cylinder 214 (FIG. 8). Box forming piston 210 is firmly affixed to the extendible rod 213 of ram 212, as shown in FIG. 14. FIG. 14 also depicts the way in which additional side plates 215 may be temporarily fastened with screws and wing nuts to the four sides of box forming piston 210, slightly increasing the size of piston 210, thereby adapting it to the formation of box lids, as hereinafter described.

Figure 9:
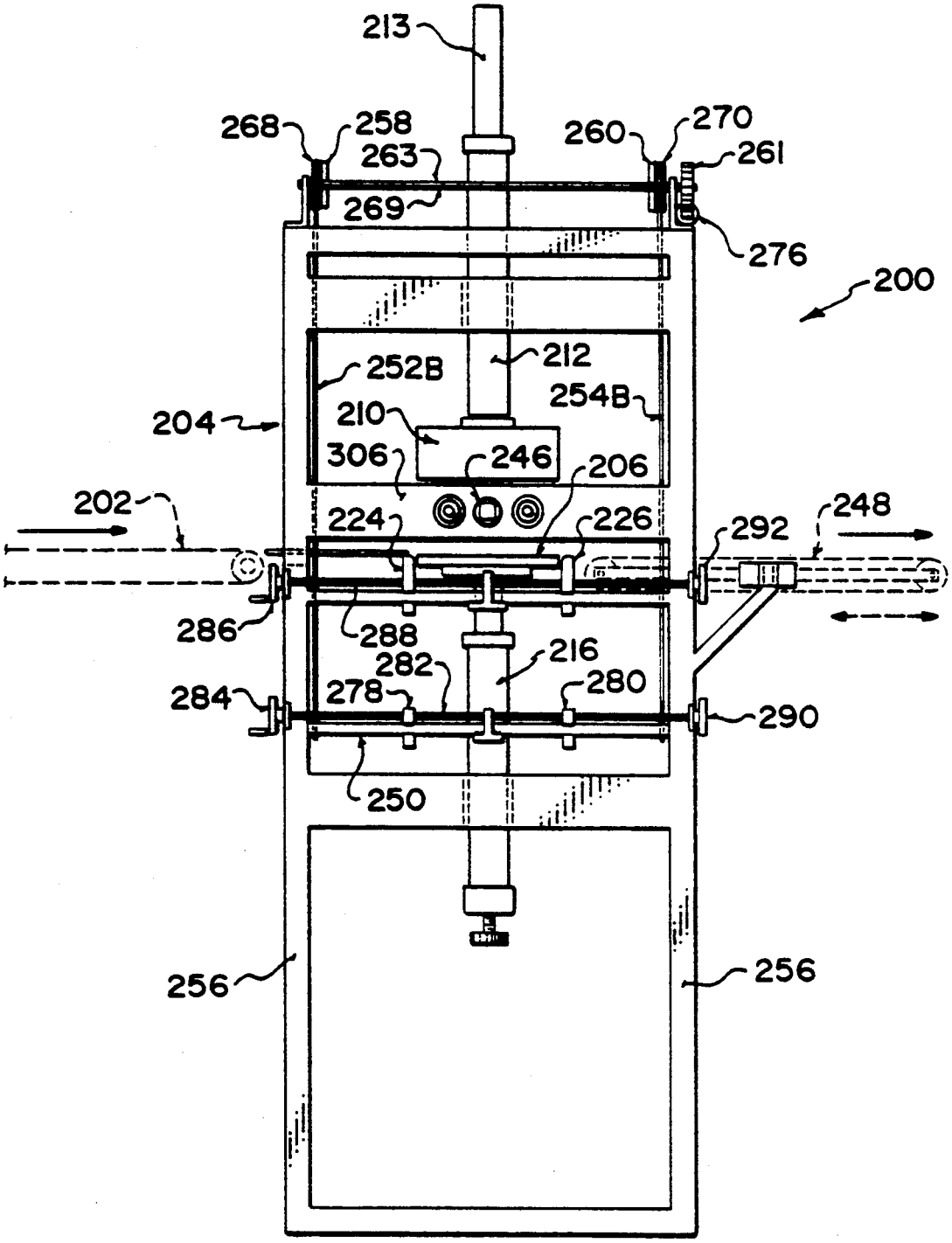
FIG. 9 is a right side elevation view of the apparatus of FIG. 7 various portions of the apparatus having been omitted from FIG. 9 to avoid obscuring details of the portions shown.
Figure 10:
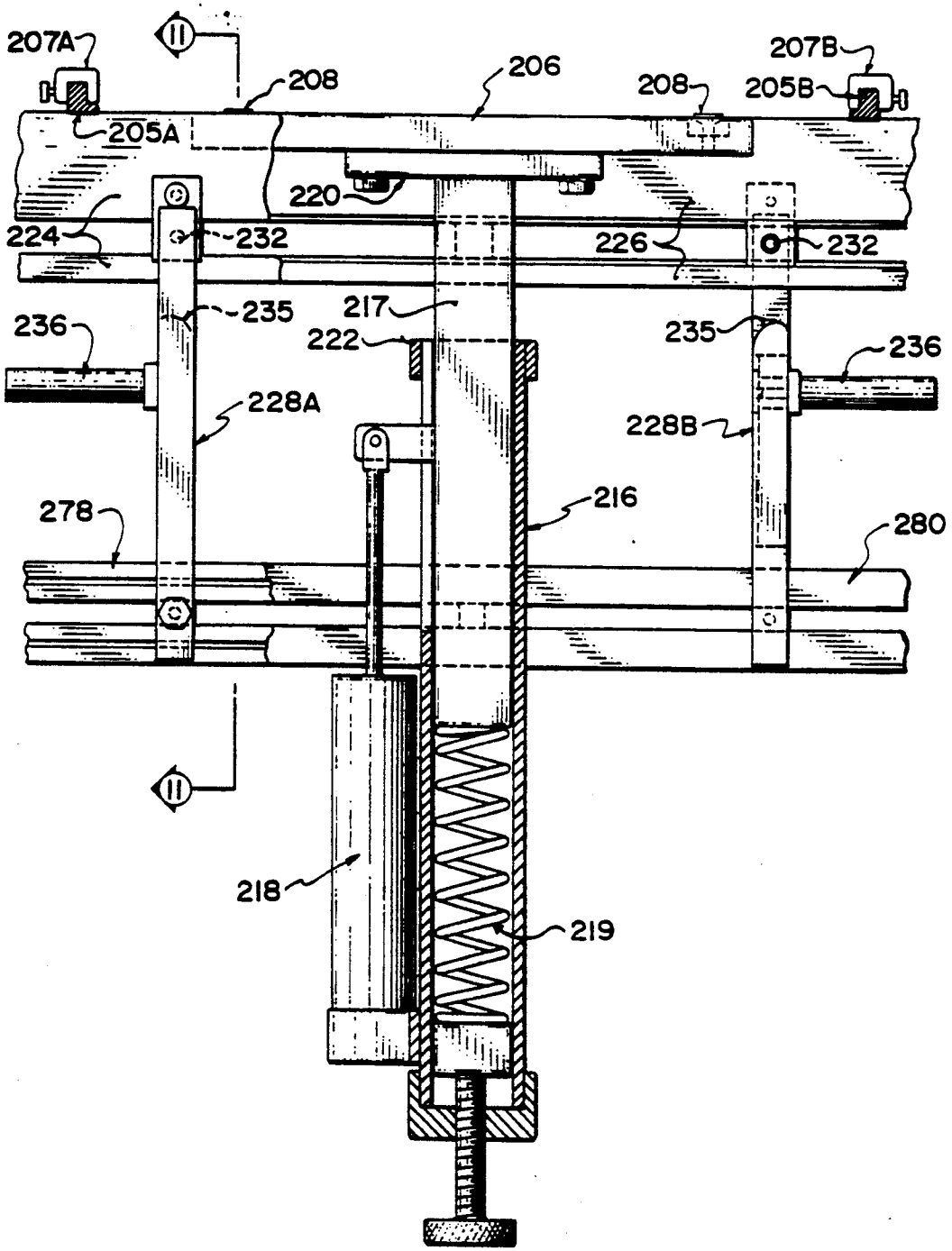
FIG. 10 is an enlarged view, partially in section, of the vacuum plate and supporting ram of the apparatus of FIG. 7.

As best seen in FIG. 10, vacuum plate 206 is firmly attached atop the extendible rod 217 of a second pneumatic ram 216 which may be actuated, as hereinafter described, via pneumatic cylinder 218 (FIG. 8). Box forming piston 210 is vertically aligned over vacuum plate 206. Box forming piston 210 (without additional side plates 215) and vacuum plate 206 each have a size and shape identical to the size and shape of rectangular base member 12. When box forming piston 210 contacts the box blank resting atop vacuum plate 206, extendible rod 217 is forced downwardly within ram 216, compressing spring 219, until the lower surface of vacuum plate base flange 220 contacts the upper surface of ram collar 222. As piston 210, box blank 10 and vacuum plate 206 descend beneath the position of vacuum plate 206 depicted in FIG. 9, folded, glued first and third side members 22, 26 contact vertical members 224, 226 respectively thus forcing first and third side members 22, 26 upwardly. As box forming piston 210, box blank 10 and vacuum plate 206 continue their descent, first and third side members 22, 26 are forced into perpendicularity with base member 12 and are held between box forming piston 210 and the inner surfaces of members 224, which together comprise a first pair of fixed, parallel frame members.

Figure 7:
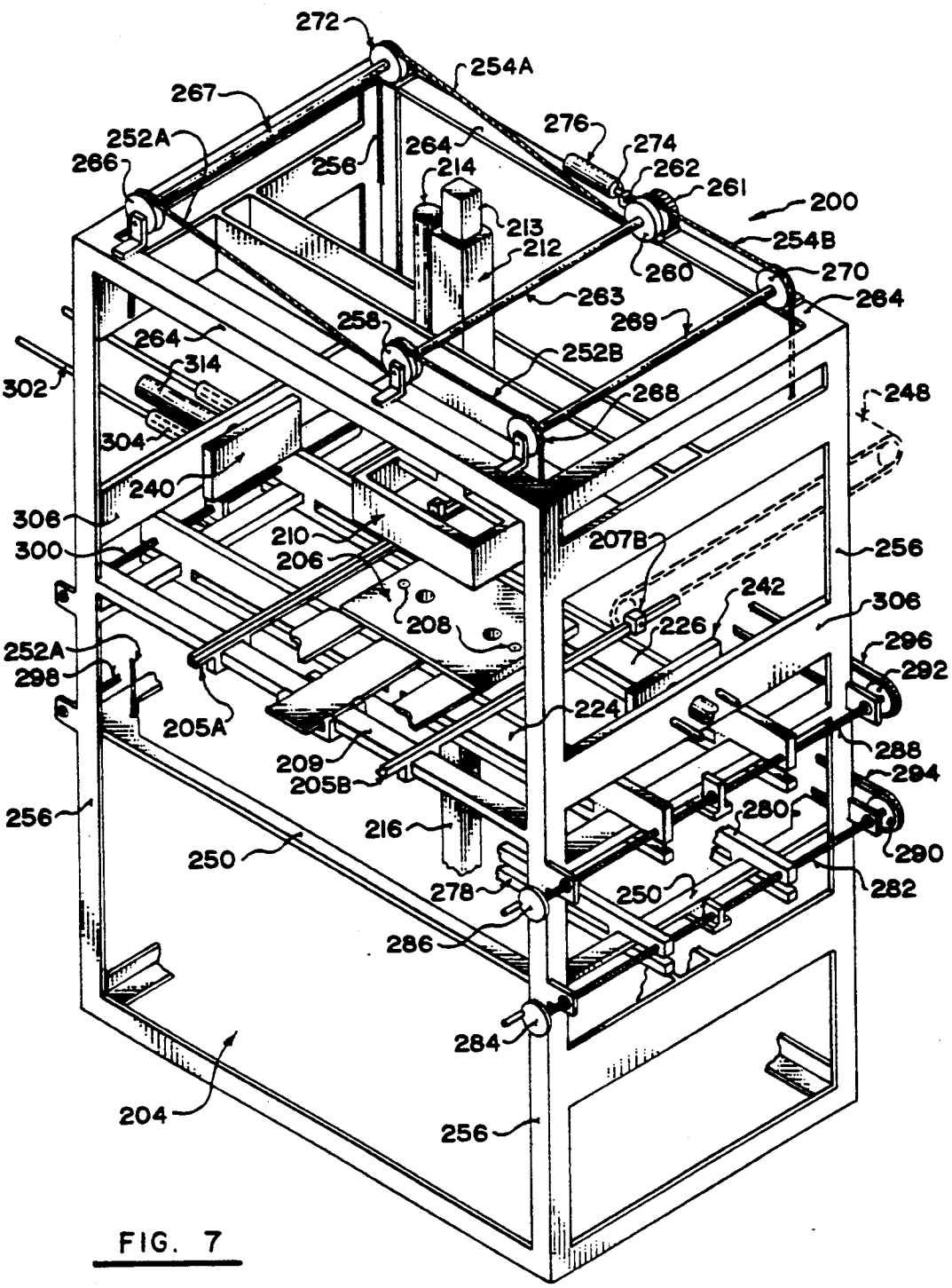
FIG. 7 is an oblique, partially fragmented, pictorial illustration of an apparatus for forming the box blank depicted in FIG. 2 into the box depicted in FIG. 5.
Figure 16:
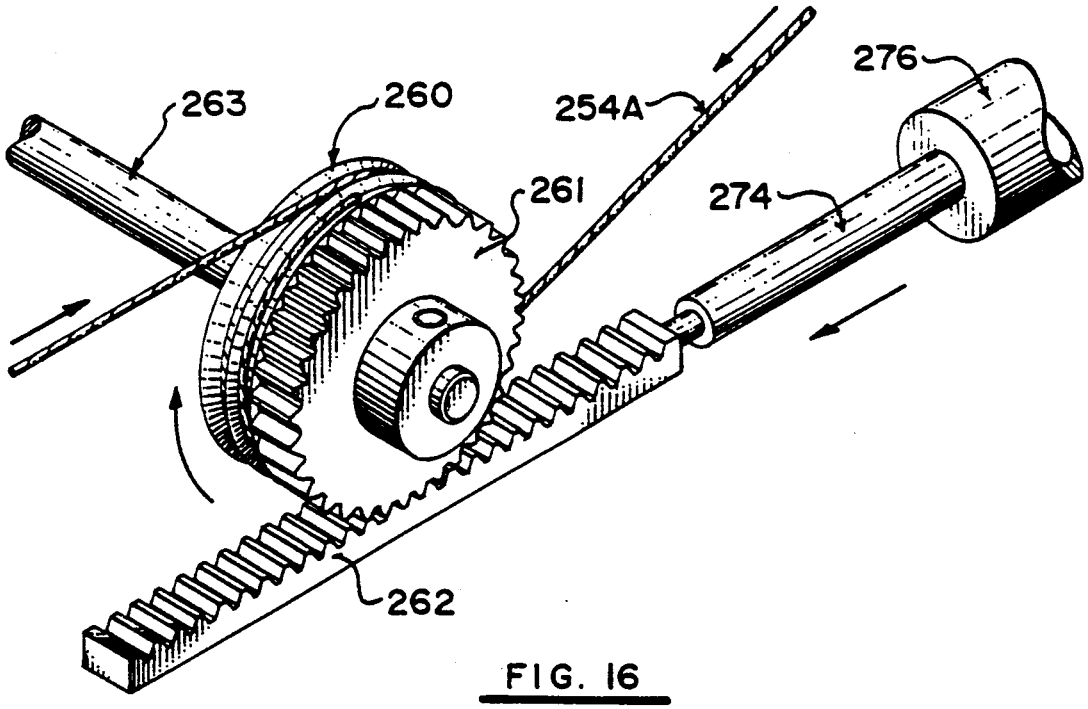

As seen in FIGS. 7, 8 and 9, a movable, horizontal, rectangular frame 250 is suspended from cables 252*a*, 252*b*, 254*a* and 254*b* such that the outer corners of frame 250 project within internal corners formed by rightangled support members 256, which comprise the upright structural supports of apparatus 200. Cables 252*a*, 252*b* and 254*a*, 254*b* are respectively entrained over and fixed to pulleys 258, 260. As seen in FIGS. 7, 9 and 16, pulleys 258, 260 are fixed on rod 263 thus rotatably coupling pulleys 258, 260 together. Rod 263 is in turn fixed to gear 261, which engages geared rack 262 slidably mounted atop the upper rear transverse structural support 264 of apparatus 200. Cables 252*a*, 252*b*, 254*a*, 254*b* are further respectively entrained over guide pulleys 266, 268, 270, 272 respectively mounted atop upper transverse supports 264 near their intersections with upright supports 256, such that the cables project downwardly within the internal corners formed by supports 256. The remote ends of the cables are respectively fastened at the corners of frame 250. Pulleys 266, 272 are fixed at the opposed ends of rod 267; and, pulleys 268, 270 are fixed at the opposed ends of rod 269. Rods 263, 267 and 269 respectively ensure that pulley pairs 258, 260; 266, 272; and, 268, 270 rotate in unison.

Pin 274 is controllably projected from pneumatically actuated cylinder 276 to contact one end of geared rack 262 (FIGS. 7 and 16). As illustrated by the arrows in FIG. 16, outward projection of pin 274 from cylinder 276 displaces rack 262 to the left (rack 262 being slidably mounted as aforesaid) which causes clockwise rotation of gear 261. Gear 261 causes corresponding clockwise rotation of rod 263, which in turn rotates pulleys 258, 260 in unison. As seen in FIG. 16, clockwise rotation of pulley 260 winds equal amounts of cables 254*a*, 254*b* onto pulley 260. Pulley 258 concurrently rotates to wind the same equal amounts of cables 252*a*, 252*b* onto pulley 258. Frame 250 is thus raised within upright supports 256 by a controlled amount and in such a manner that the plane of frame 250 remains horizontal.

Frame 250 is lowered in similar fashion, by controllably retracting pin 274 within cylinder 276. This allows rack 262 to slide to the right (as viewed in FIG. 16) causing counter-clockwise rotation of gear 261. Gear 261 causes corresponding counter-clockwise rotation of rod 263, which in turn rotates pulleys 258, 260 in unison. Counter-clockwise rotation of pulley 260 unwinds equal amounts of cables 254*a*, 254*b* from pulley 260. Pulley 258 concurrently rotates to unwind the same equal amounts of cables 252*a*, 252*b* from pulley 258. Frame 250 is thus allowed to descend within upright supports 256 by a controlled amount and in such a manner that the plane of frame 250 remains horizontal. Guide means, such as rollers (not shown) may be provided on each of the outer corners of frame 250 to prevent binding of frame 250 within supports 256 as frame 250 is raised and lowered. The cables, pulleys, rod, gear, rack and controllable pin together comprise a "frame moving means" for vertically displacing movable frame 250.

A second pair of parallel, slotted frame members 278, 280 extend between the opposed sides of movable frame 250. As seen in FIGS. 7, 8 and 9, members 278, 280 threadably engage elongate screw 282. Crank 284 may be manually rotated to adjust the spacing between members 278, 280. The spacing between the first pair of frame members 224, 226 is similarly adjusted by manual rotation of crank 286, which rotates elongate screw 288 to which members 224, are threadably coupled.

Gears (or sprockets) 290, 292 are respectively fixed to the ends of screws 282, 288 opposite cranks 284, 286. Chains 294, 296 respectively drivingly couple gears 290, 292 to identical gears (not visible in the drawings) fixed to the ends of screws 298, 300 (FIG. 7) which respectively threadably engage the ends of members 278, and, members 224, 226 opposite those engaged by screws 282, 288. These screw-gear-chain drive arrangements ensure that rotation of either of cranks 284 or 286 causes equal displacement at both ends of members 278, 280; or, members 224, 226.

Figure 11:
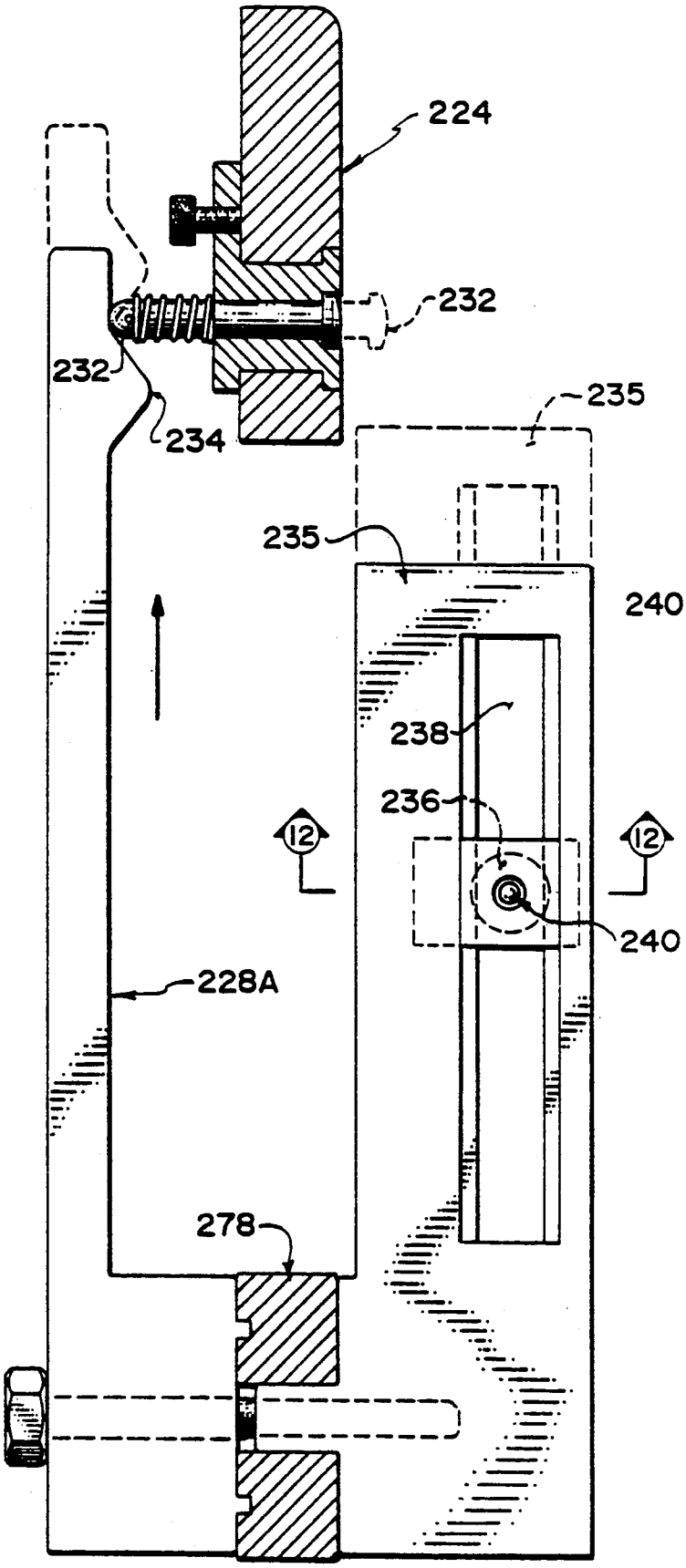
FIG. 11 is an enlarged cross-sectional view taken with respect to the lines 11—11 shown in FIG. 10.
Figure 12:
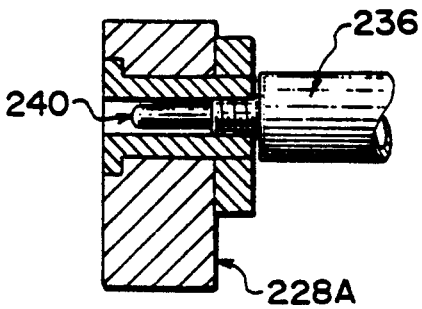
FIG. 12 is a cross-sectional view taken with respect to the lines 12—12 shown in FIG. 11.

A third pair of parallel, U-shaped frame members 228*a* and 228*b* (FIGS. 10 and 11) are adjustably fixed to slotted member 278. A corresponding third pair frame members (not visible in the drawings) are adjustably fixed to slotted member 280. Members 228*a*, 228*b* extend towards first frame members 224, 226. As frame 250 is raised, it carries members 278, 280, 228*a* and 228*b* upward with respect to members 224, 226. Frame members 228*a*, 228*b* (and the two corresponding but not visible frame members), are each provided with a cam surface 234 (FIG. 11). "Flap tuck means", namely spring-loaded, slidably displaceable pins 232 are adjustably fastened to each of members 224, 226 such that one pin is vertically aligned with one of each of the four cams. As members 228*a* and 228*b* (and the two corresponding but not visible frame members) move upward with respect to fixed frame members 224, 226 the base of each pin 232 is carried over the corresponding cam 234, thus forcing each pin outwardly into the position shown in dotted outline in FIG. 11. The heads of each pin contact the outer surface of one of side flaps 46, 48, 50, 52 tucking the side flaps inwardly into the position depicted in FIG. 3.

Once the base of pin 232 has passed over about three quarters of the surface of cam 234, a "flap raising means", namely the end of vertically projecting segment 235 of U-shaped frame member 228*a* (FIG. 11) will have been carried upwardly into contact with the underside of one of second and fourth side members 24, 28, raising the side members upwardly into the positions depicted in FIG. 3, thus preventing flaps 46, 48, 50 and 52 from springing outwardly from the right angle positions depicted in FIG. 3. As frame member 228*a* proceeds upwardly relative to frame member 224, segment 235 of frame member 228*a* raises either of second or fourth side members 24, 28 into the full upriqht position depicted in FIG. 4. If desired, vertically projecting bars (not shown) may be provided at the centers of each opposed end of frame 250 to hold the box in place and to prevent outward bowing of the box sidewalls. The end of segment 235 terminates beneath cam 234 to ensure that side flaps 46, 48, 50, 52 are tucked into position before second and fourth side members 24, 28 are raised into the full upright position. The identical structure and action is provided and performed with respect frame member 228*b* and the two corresponding but not visible frame members.

At this point, box forming piston 210 is momentarily withdrawn from the partially formed box by actuating ram 212. A "flap folding means", namely controllably actuable pneumatic cylinder 236 (FIGS. 11 and 12) adjustably fastened within slot 238 of segment 235 is then fired, forcing pin 240 outwardly (i.e. to the left, as viewed in with the outer surface of one of second or fourth outer portions 36, 44 respectively, thus inclining those portions at an angle as depicted, in FIG. 4A, in respect of portion 36. Ram 212 is then again actuated to force box forming piston 210 downwardly. The edges of box forming piston 210 contact the upper surfaces of partially folded portions 36, 44 and carry those portions downwardly, folding them flush against second and fourth inner portions 36, 42 respectively.

Second hydraulic ram 216 is then actuated to raise vacuum plate 206, folded box blank 10 and box forming piston 210 upwardly to leave the base of vacuum plate 206 level with the bottom edges of side rams 240, 242. Side rams 240, 242 (FIGS. 7, 8 and 13) are then actuated via pneumatic cylinders 244, 246 respectively, forcing the side rams firmly against second and fourth outer portions 34, 42 respectively and compressing second and fourth inner and outer portions 34, 36, 42, 44 respectively between rams 240, 242 and the outer surfaces of box forming piston 210, thus firmly adhering the previously glued portions together. Side rams 240, 242 and box forming piston 210 are then withdrawn, leaving finished box 100 atop vacuum plate 206. Second hydraulic ram 216 is then actuated to return vacuum plate 206 to the neutral position depicted in FIGS. 7, 8 and 9.

Figure 13:
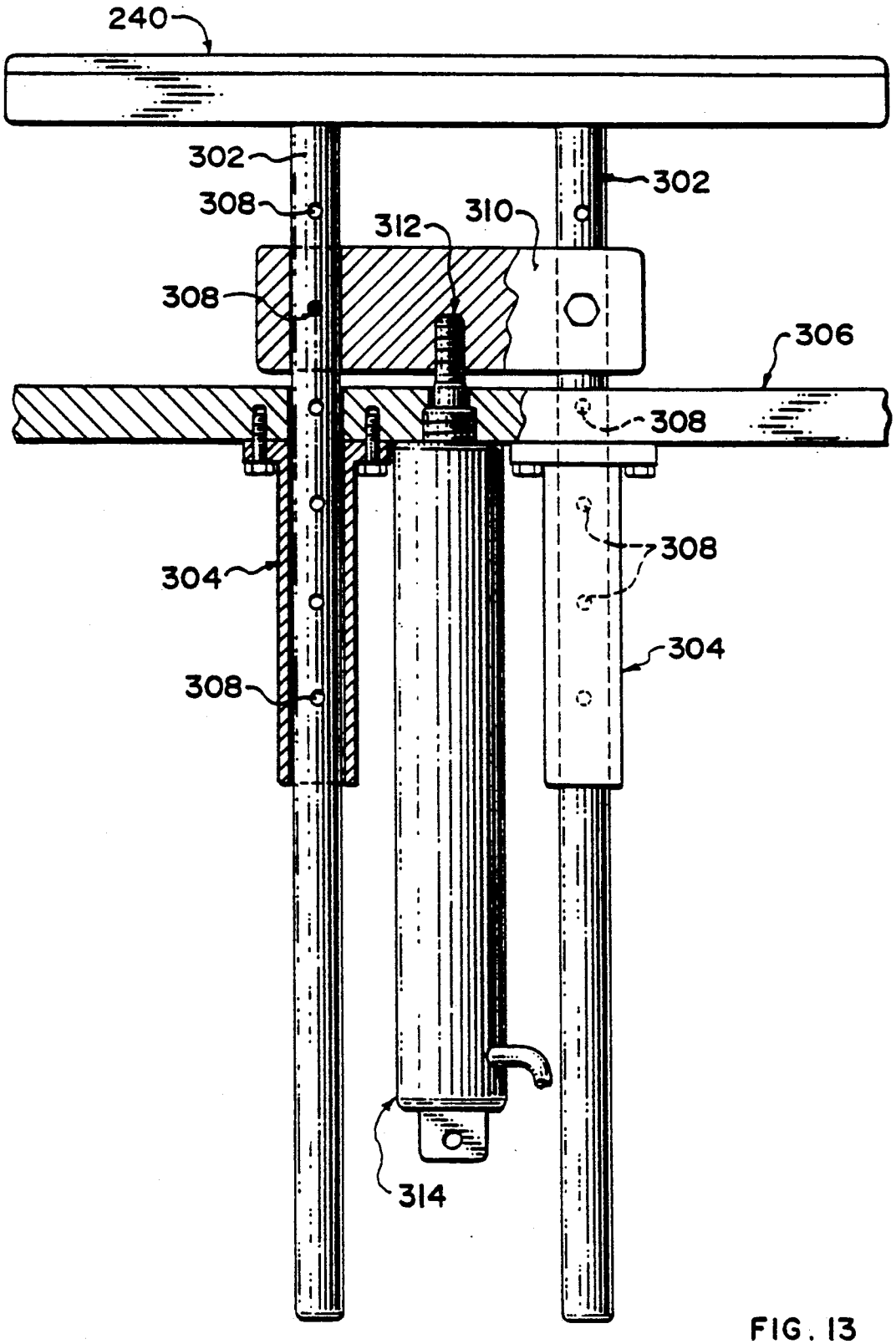
FIG. 13 is a top plan view, partially in section, of one of the side rams of the apparatus of FIG. 7.

As depicted in FIG. 13, each side ram is fixed to a pair of guide rods 302 which slide within sleeves 304. Sleeves 304 are fastened to transverse brace members 306 fixed between upright structural support members 256 (FIG. 7). Spaced apertures 308 provided in each of rods 302 facilitate affixation of block 310 to rods 302 at a selected point to minimize the travel of the side rams in relation to the size of the box being formed. The rod 312 of pneumatic cylinder 314 is coupled to block 310. Accordingly, controlled pneumatic actuation of cylinder 314 extends or retracts rod 312, which in turn extends or retracts the side ram.

As side rams 240, 242 are withdrawn to leave finished box 100 atop vacuum plate 206, a fresh, partially folded, glued box blank is inserted as aforesaid via conveyor 202. The leading edge of the fresh box blank contacts the outer surface of finished box 100, forcing finished box 100 to the riqht (as viewed in FIG. 9) onto conveyor 248, which transports finished box 100 away from apparatus 200.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Box forming apparatus, for forming a box from a box blank having a base with first, second, third and fourth side members extending along respective sides of said base, one opposed pair of said side members having parallel inner and outer portions, the other opposed pair of said side members having flaps extending from each opposed end of said other side members, said box forming apparatus having a first pair of spaced, parallel frame members horizontally slidable mounted on a fixed framework; a box forming plate vertically displaceable between said first frame members; a rectangular box forming piston vertically aligned with said box forming plate and displaceable between said first frame members, against said box forming plate; said box forming plate and said piston having the same size and shape as said base; means for vertically displacing said box forming plate; means for vertically displacing said box forming piston; said apparatus further characterized by:

(a) a movable frame vertically displaceable beneath said first frame members;

(b) means for vertically displacing said movable frame;

(c) flap tuck means on said first frame members for folding said flaps perpendicular to said other side members, said flap tuck means actuable by vertical displacement of said movable frame toward said first frame members;

(d) flap raising means on said movable frame for moving said side members having parallel inner and outer portions upwardly relative to said base; and, (e) controllably actuable flap folding means on said movable frame for inclining said outer portions of said side members at an angle relative said inner portions of said side members.

2. Box forming apparatus as defined in claim 1, further comprising frame moving means for vertically displacing said movable frame, said frame moving means comprising:

(a) a cable coupled between said movable frame and a pulley rotatably mounted on said framework; and, (b) controllable drive means for controllably rotating said pulley.

3. Box forming apparatus as defined in claim 2, wherein said controllable drive means further comprises:

(a) a gear fixed to said pulley;

(b) a slidably displaceable, geared rack drivingly coupled to said gear; and, (c) means for controllably slidably displacing said rack.

4. Box forming apparatus as defined in claim 3, wherein said means for controllably slidably displacing said rack comprises a cylinder having a slidably displaceable pin mounted for engagement with said rack.

5. Box forming apparatus as defined in claim 1, further comprising:

(a) first and second rotatably coupled pulleys rotatably mounted on said framework;

(b) first and second pairs of cables respectively coupled between said pulleys and said movable frame;

(c) a gear fixed to one of said pulleys;

(d) a slidably displaceable, geared rack drivingly coupled to said gear; and, (e) means for controllably slidably displacing said rack.

6. Box forming apparatus as defined in claim 5, wherein said means for controllably slidably displacing said rack comprises a cylinder having a slidably displaceable pin mounted for engagement with said rack.

7. Box forming apparatus as defined in claim 1, further comprising adjusting means for slidably adjusting the displacement between said first pair of parallel frame members.

8. Box forming apparatus as defined in claim 7, wherein said adjusting means comprises screw feed means threadably coupled between said first pair of parallel frame members.

9. Box forming apparatus as defined in claim 7, wherein said adjusting means comprises first and second screw feed means threadably coupled between opposed ends of said first pair of parallel frame members.

10. Box forming apparatus as defined in claim 9, further comprising drive means interconnecting said first and second screw feed means.

11. Box forming apparatus as defined in claim 10, wherein said drive means comprises:

(a) first and second gears respectively fixed at opposed ends of said first and second screw feed means; and, (b) a chain drivingly coupled between said first and second gears.

12. Box forming apparatus as defined in claim 1, further comprising:

(a) a second pair of parallel frame members mounted on said movable frame;

(b) a third pair of parallel frame members mounted on each of said second pair of parallel frame members and extending towards said first frame members;

wherein said flap raising and flap folding means are mounted on said third frame members.

13. Box forming apparatus as defined in claim 12, further comprising adjusting means for adjusting the displacement between said second pair of parallel frame members.

14. Box forming apparatus as defined in claim 13, wherein said adjusting means comprises screw feed means threadably coupled between said second pair of parallel frame members.

15. Box forming apparatus as defined in claim 13, wherein said adjusting means comprises first and second screw feed means threadably coupled between opposed ends of said second pair of parallel frame members.

16. Box forming apparatus as defined in claim 15, further comprising drive means interconnecting said first and second screw feed means.

17. Box forming apparatus as defined in claim 16, wherein said drive means comprises:

(a) first and second gears respectively fixed at opposed ends of said first and second screw feed means; and, (b) a chain drivingly coupled between said first and second gears.

18. Box forming apparatus as defined in claim 12, wherein said flap tuck means comprises:

(a) a slidably displaceable pin mounted on one of said first frame members; and, (b) a cam on one of said third frame members, said cam aligned to displace said pin as said movable frame is vertically displaced toward said first frame members.

19. Box forming apparatus as defined in claim 12, wherein said flap tuck means comprises:

(a) first, second, third and fourth slidably displaceable pins respectively mounted on said first frame members; and, (b) first, second, third and fourth cams respectively mounted on said third frame members, said cams respectively aligned to displace said pins as said movable frame is vertically displaced toward said first frame members.

20. Box forming apparatus as defined in claim 18, wherein said flap raising means comprises a vertically projecting segment on one of said third frame members, the end of said segment terminating beneath said cam.

21. Box forming apparatus as defined in claim 19, wherein said flap raising means comprises first, second, third and fourth vertically projecting segments on said respective third frame members, the ends of said segments terminating beneath said cams.

22. Box forming apparatus as defined in claim 20, wherein said flap folding means comprises a controllably actuable piston mounted beneath said end of said segment.

23. Box forming apparatus as defined in claim 22, wherein said flap folding means comprises first, second, third and fourth controllably actuable pistons respectively mounted beneath said ends of said first, second, third and fourth segments.

24. Box forming apparatus as defined in claim 1, further comprising first and second side rams mounted on said framework for slidable displacement toward one another, against opposed sides of said box forming piston.

* * * * *